United States Patent [19]

Samol et al.

[11] 4,443,018

[45] Apr. 17, 1984

[54] GASKET FRAME MADE OF ELASTOMER MATERIAL

[75] Inventors: Gerd W. Samol, Heimenkirch; Horst Pittel, Burgwedel, both of Fed. Rep. of Germany

[73] Assignee: Metzeler Kautschuk GmbH, Munich, Fed. Rep. of Germany

[21] Appl. No.: 385,004

[22] Filed: Jun. 4, 1982

[30] Foreign Application Priority Data

Jan. 12, 1982 [DE] Fed. Rep. of Germany ..... 3200652

[51] Int. Cl.[3] ..... F16J 15/02; B29H 7/00

[52] U.S. Cl. ..... 277/189; 277/235 R

[58] Field of Search ..... 277/184, 235 R, 180

[56] References Cited

U.S. PATENT DOCUMENTS

| | | | |
|---|---|---|---|
| 2,314,386 | 3/1943 | Brend | 277/189 |
| 3,431,348 | 3/1969 | Nellis et al. | 277/235 R |
| 3,542,382 | 11/1970 | Magmann | 277/235 R |
| 3,622,427 | 11/1971 | Kelly | 277/235 R |
| 3,857,574 | 12/1974 | Artzer | 277/235 R |
| 3,969,572 | 7/1976 | Rostek | 277/235 R |

FOREIGN PATENT DOCUMENTS

| | | |
|---|---|---|
| 832489 | 2/1952 | Fed. Rep. of Germany . |
| 2007757 | 6/1978 | Fed. Rep. of Germany . |
| 2553304 | 6/1980 | Fed. Rep. of Germany . |

*Primary Examiner*—Robert I. Smith

*Attorney, Agent, or Firm*—Herbert L. Lerner; Laurence A. Greenberg

[57] ABSTRACT

Gasket frame made of elastomeric material, in particular made of silicon rubber, with straight gasket profile portions and closed angular corners. At each corner of the gasket frame there is inserted a leg of a metallic angle into the end regions of the gasket profile portions, which are provided with a hollow space extending in the longitudinal direction of said miter-cut gasket portions. The legs are adhesively connected with the corresponding end region of the gasket portions.

6 Claims, 3 Drawing Figures

GASKET FRAME MADE OF ELASTOMER MATERIAL

BACKGROUND OF THE INVENTION

1. Field of the Invention

The invention relates to a gasket frame made of elastomer material, in particular silicone rubber, with straight gasket profile portions and closed angular corners.

2. Description of the Prior Art

Such gaskets or gasket frames which must also withstand high temperatures are frequently used in doors for baking ovens to prevent the undesirable escape of waste gases and therewith connected local heat loss, as well as the dirt accumulations necessarily occurring by the condensation of waste vapors at places where the door is not tight.

It is known from German Published Prosecuted Application DE-AS 25 53 304 for the manufacture of such closed gasket frames, to insert prefabricated arc-pieces in a raw unvulcanized state between already vulcanized profiled portions (sections), and thereafter to connect them by vulcanizing with the straight profiled portions.

Furthermore, it is known from German patent DE-PS 832,489 to clamp straight profiled portions with their ends in a vulcanizing mold, and to spray the freely-exposed corner part with a non-vulcanized rubber mixture, and to vulcanize it thereafter.

A further possibility is, according to German Patent DE-PS 20 07 757 to make the whole gasket frame completely in a mold.

All these known methods have the disadvantage that they are very costly, and this applies also for the installation of the so manufactured gasket frames, and their eventual required exchange.

SUMMARY OF THE INVENTION

In contrast thereto, the invention has the basic objective providing a gasket frame which can be easily manufactured and installed, and especially one which can also be easily exchanged, and which has an optimal sealing performance.

With the foregoing and other objects in view, there is provided in accordance with the invention a gasket frame made of elastomeric material with straight gasket profile portions and closed angular corners, wherein at each corner of the gasket frame a first leg of a metallic angle extends through a miter-cut end into the end region of a first straight gasket profile portion forming a corner, said first gasket profile portion having a hollow space extending in the longitudinal direction of the gasket portion to accommodate the first leg of the metallic angle, and a second leg of said metallic angle similarly extends through a miter-cut end of a second profile portion forming said corner, and wherein said legs are adhesively connected with the corresponding end regions of the gasket profile portions.

Other features which are considered as characteristic for the invention are set forth in the appended claims.

Although the invention is illustrated and described herein as embodied in a gasket frame made of elastomer material, it is nevertheless not intended to be limited to the details shown, since various modifications may be made therein without departing from the spirit of the invention and within the scope and range of equivalents of the claims.

BRIEF DESCRIPTION OF THE DRAWINGS

The invention, however, together with additional objects and advantages thereof will be best understood from the following description when read in connection with the accompanying drawings, in which.

DETAILED DESCRIPTION OF THE INVENTION

In accordance with the invention, at the corners of the gasket frame, a leg of a metallic angle is inserted into each adjacent end region of the profiled portions which each have a hollow interior extending in the longitudinal direction, and are connected by an adhesive with the end-region of the corresponding gasket portion. The metallic angle has at its corner region two parallel and diagonally extending cuts forming a tongue which can be bent upward. This tongue then extends to the outside through a cut-out in the profiled gasket material which covers it.

In a method for the manufacture of such a gasket frame, the end portions of two miter-cut gasket sections having hollow interiors filled with adhesive are pushed onto the legs of a flat metallic angle until their miter-cut edges touch each other.

Thus, it becomes possible to produce a closed gasket frame from straight, extruded profile sections with rectangular corners, which can be hung with its integrated holding means in a baking oven door for instance, and which can be easily removed, if necessary.

The construction and performance of a typical embodiment according to the invention are further explained with the aid of the drawings.

Figure 1:
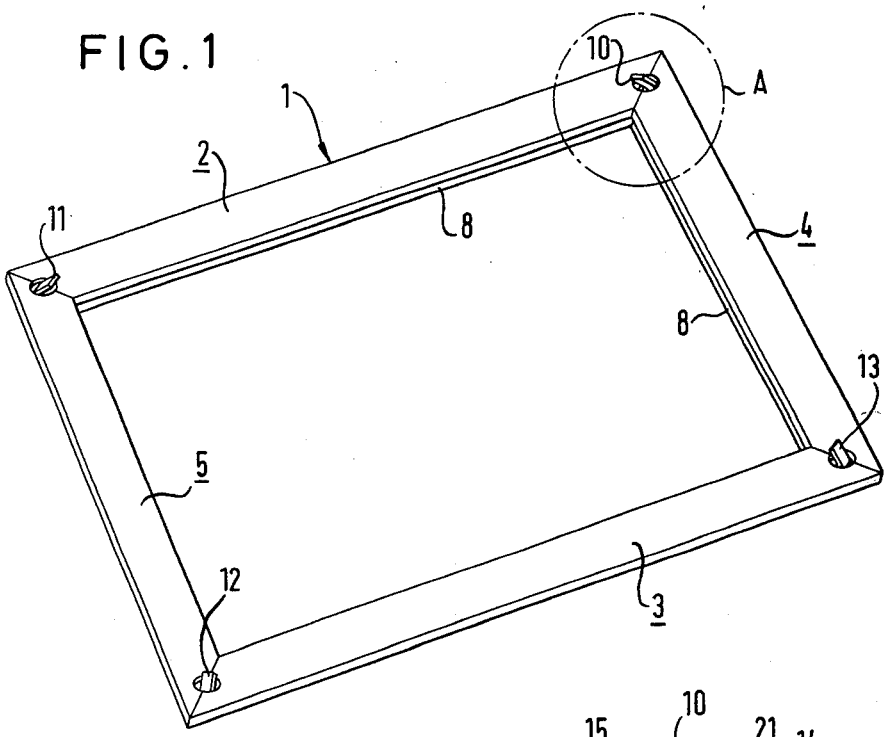
FIG. 1 diagrammatically illustrates a finished rectangular gasket frame made up of four straight gasket profile portions with miter-cut ends with a hook-shaped tongue at each corner projecting above the surface of the profiles.
Figure 3:
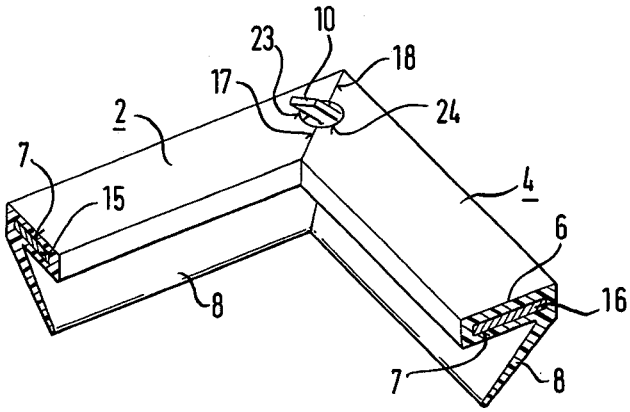
FIG. 3 is the same corner section in the final assembly state.

As shown in FIG. 1, the finished, for example rectangular gasket frame 1 is constructed of two longer gasket profile portions 2 and 3, and two shorter portions 4 and 5, which have an approximately rectangular, hollow cross section 6, as most clearly shown in the sectioned view according to FIG. 3, with a hollow space 7 extending in the longitudinal direction, and a flexible sealing lip 8, which is, in an approximately V-shaped configuration, formed at the outer edge.

Four hook-shaped tongues 10 to 13 of the inserted metallic angles are shown in FIG. 1 at the corners of the gasket frame 1; this will be explained in detail further on.

Figure 2:
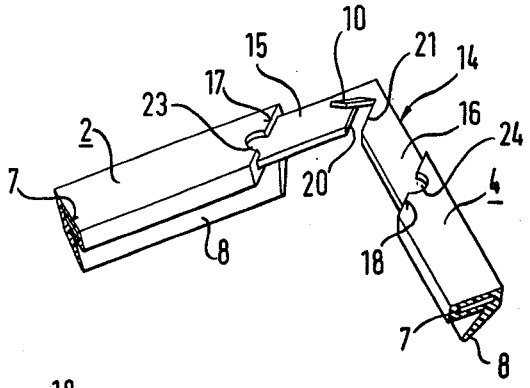
FIG. 2 is a corner section corresponding to the cut-out A according to FIG. 1, with the metallic angle partially exposed.

The upper right corner of the gasket frame 1, corresponding to cut-out A in FIG. 1, is shown in an enlarged scale in FIGS. 2 and 3. FIG. 2 shows the gasket frame in a semi-finished state, as explained in the following:

First, a metallic flat angle 14 serves as holder and support for each corner of the frame. The two legs 15 and 16 of the angle form the desired corner angle. The respective ends of the straight gasket profile portions 2 and 4 are pushed onto these two legs 15 and 16, after the ends are mitered (miter-cut) with the half corner angle corresponding to the exposed cut edges 17 and 18, and the hollow spaces 7 of the profiles 2 and 4 have been injected with a suitable amount of adhesive. Thereafter, the gasket portions 2 and 4 are completely pushed onto the legs 15 and 16 of the angle 14, until the mitered edges 17 and 18 touch each other, as shown in FIG. 3.

As shown in FIG. 2, the angle 14 has two cuts 20 and 21 starting from its inner corner, and extending parallel and diagonally from the interior corner to about the middle of the width of the angle, so that an exposed tongue 10 is formed which can be bent up as shown in the drawing. The two gasket profile portions 2 and 4 are provided at their upper miter cut edges 17 and 18 with semi-circular cut-outs 23 and 24, so that after the gasket portions 2 and 4 are completely pushed onto the angle, an opening is formed in the profile material through which the turned up tongue 10 extends above the surface of the profiles to the outside.

The other corners of the gasket frame 1 are constructed and manufactured in the same manner. The four tongues 10 to 13, extending from the surface of the gasket frame 1, can be directly inserted into corresponding holes, for example, in a door of a baking overn which is to be sealed, thereby making a very simple installation without further auxiliary means possible. Such a gasket can also easily be removed or, if necessary, exchanged.

By the described construction, rectangular gasket frames with closed corners can be easily produced from extruded, straight gasket profiles, whereby such gasket frames assure a reliable seal, and additionally make a very simple installation possible.

We claim:

1. Gasket frame made of elastomeric material with straight gasket profile portions and closed angular corners, wherein at each corner of the gasket frame a first leg of a metallic angle extends through a miter-cut end into the end region of a first straight gasket profile portion forming a corner, said first gasket profile portion having a hollow space extending in the longitudinal direction of the gasket portion to accommodate the first leg of the metallic angle, and a second leg of said metallic angle similarly extends through a miter-cut end of a second profile portion forming said corner, and wherein said legs are adhesively connected with the corresponding end regions of the gasket profile portions.

2. Gasket frame according to claim 1, wherein the elastomeric material is silicone rubber.

3. Gasket frame according to claim 1, wherein the metallic angle has in its corner region two parallel and diagonally extending cuts for forming a tongue which can be bent upward.

4. Gasket frame according to claim 2, wherein the metallic angle has in its corner region two parallel and diagonally extending cuts for forming a tongue which can be bent upward.

5. Gasket frame according to claim 3 or claim 4, wherein the tongue extends above the surface of the gasket profile material through a cut-out in the gasket profile material.

6. Gasket frame according to claim 1, wherein the gasket profile has an approximately rectangular hollow profile with a sealing lip arranged in a V-shaped configuration.

* * * * *